United States Patent [19]

Husbands

[11] Patent Number: 4,594,016

[45] Date of Patent: Jun. 10, 1986

[54] FLIP CARD FILE HOLDER

[76] Inventor: Calvin G. Husbands, 7237 SW. Canyon Dr., Portland, Oreg. 97225

[21] Appl. No.: 579,526

[22] Filed: Feb. 13, 1984

[51] Int. Cl.[4] ..... B42F 17/00; B42F 17/08; B42F 13/02

[52] U.S. Cl. ..... 402/75; 402/74; 402/73; 402/21; 312/245

[58] Field of Search ..... 402/19, 21, 73, 74, 402/75; 312/183, 186, 187, 245

[56] References Cited

U.S. PATENT DOCUMENTS

| | | | |
|---|---|---|---|
| 588,631 | 8/1897 | Brown | 402/21 |
| 1,422,489 | 6/1922 | Smith | 402/21 |
| 1,580,770 | 4/1926 | Welcker | 402/21 |
| 1,755,407 | 4/1930 | O'Connell | 402/501 |
| 2,754,079 | 7/1956 | Krueger et al. | 312/245 X |
| 2,829,457 | 4/1958 | Marston | 40/120 |
| 3,253,871 | 5/1966 | Karper | 402/19 |

FOREIGN PATENT DOCUMENTS

| | | | |
|---|---|---|---|
| 0495708 | 11/1950 | Belgium | 402/21 |
| 1303269 | 7/1962 | France | 402/21 |
| 0358065 | 12/1961 | Switzerland | 402/21 |

*Primary Examiner*—Robert L. Spruill
*Assistant Examiner*—Taylor J. Ross
*Attorney, Agent, or Firm*—James D. Givnan, Jr.

[57] ABSTRACT

A card file holder including a base having outwardly and upwardly divergent card supporting extensions. Pedestals on the underside of the base have angularly orientated surfaces permitting base installation on an upright wall surface or a horizontal surface. An arm assembly includes a pair of card receiving arms having a bridge therebetween at one end. The arm assembly bridge is confined within an opening in the holder base by interengageable surfaces formed on the base and bridge which permit a loaded arm assembly to be inserted into the holder base opening.

3 Claims, 7 Drawing Figures

FLIP CARD FILE HOLDER

BACKGROUND OF THE INVENTION

The present invention pertains generally to a holder on which is carried a multitude of cards having reference data thereon to which the user must make periodic reference.

Prior art card files include arm means on which the index cards may slide to a position whereat card data may be viewed. Typically, such files include a multitude of cards through which each arm of the file must be inserted. A problem exists in the tedious installation of the cards usually to a pair of card retaining arms. A further objection to known card files is the difficulty with which a fully loaded pair of card restraining arms are attached to the file base. Common in the card file art are biased arm structures. Such index files do not lend themselves to convenient card installation and removal.

Examples of known card holders are U.S. Pat. No. 3,253,871 which discloses a pair of independent card holding arms while U.S. Pat. Nos. 2,829,457 and 1,755,407 both disclose independent, biased arms for passage through a stack of cards.

SUMMARY OF THE PRESENT INVENTION

The present invention is embodied within a card holder having a detachable arm assembly.

A holder base is adapted for placement on an upright wall surface or, alternatively, for placement on a desk top. An arm assembly includes arms in fixed relationship to one another to facilitate their passage through a collection of cards and thereafter mounting of the loaded arm assembly and cards on the holder base. The arm ends are configured for inserted, retentive engagement with the holder base and may be quickly released by manual pressure if so desired.

Important objectives of the invention include the provision of a card holder having an arm assembly facilitating the installation of stacked cards thereon and the subsequent installation of the loaded arm assembly in place on a card holder base; the provision of a card holder wherein a holder base and arm assembly are each of a configuration so as to facilitate low cost production utilizing high volume molding equipment; the provision of a card holder for optional placement on an upright wall surface or a desk or counter top and which may be nested within one another for shipping.

DETAILED DESCRIPTION OF THE PREFERRED EMBODIMENT

Figure 1:
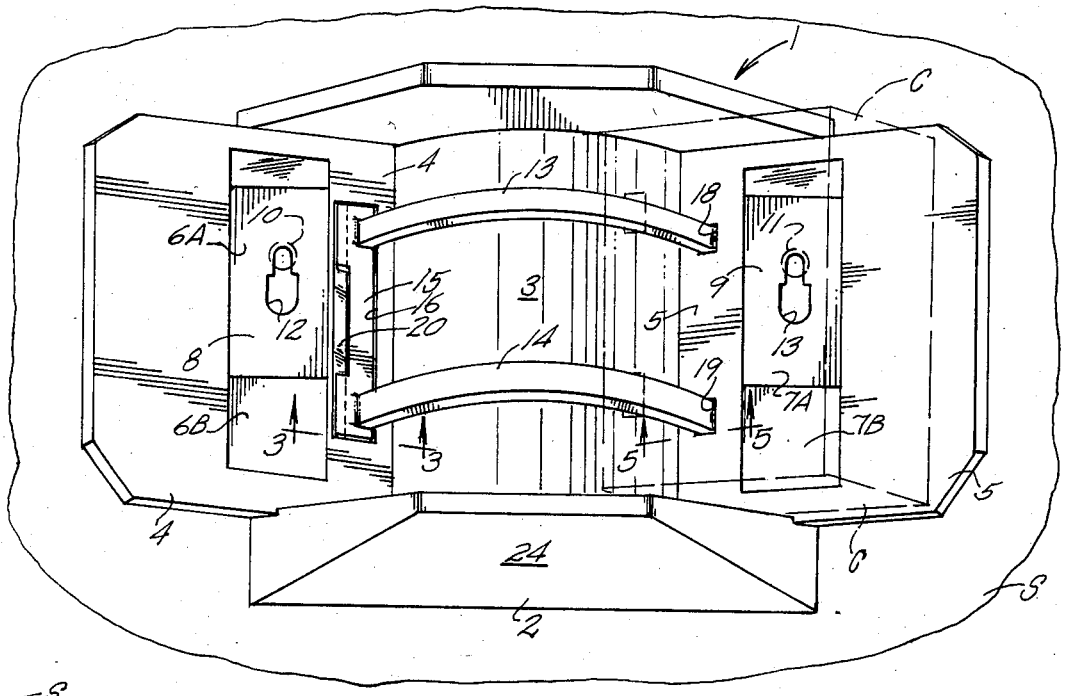
FIG. 1 is a frontal perspective view of the present card holder in place on an upright wall surface.
Figure 2:
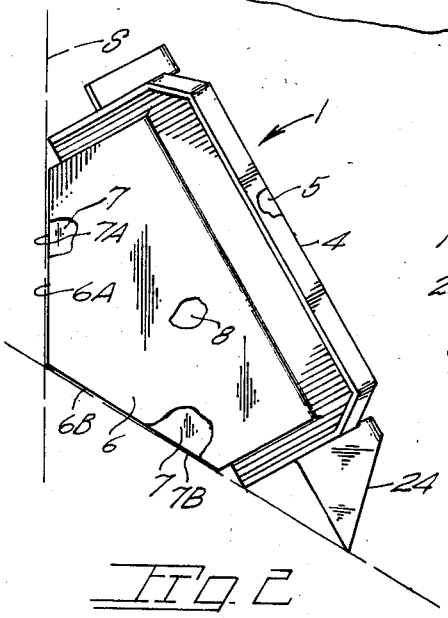
FIG. 2 is a side elevation view of FIG. 1 taken from the left end thereof.

With continuing attention to the drawing wherein applied reference numerals indicate parts similarly hereinafter identified, the reference numeral 1 indicates generally the present card file holder in place on an upright surface S.

The file is of molded construction including a molded base 2 including an upwardly curved central area 3. Diverging outwardly and upwardly in an inclined manner are card supporting extensions 4 and 5 on which a collection of cards C may rest.

Base 2 includes pedestal means as at 6 and 7 which define open areas at 8 and 9. Pedestals at 6 and 7 have upright back walls 6A-7A and bottom walls 6B-7B angularly orientated to the first mentioned walls. The rear pedestal walls 6A-7A abut the upright wall surface S when the holder is attached to a wall by mounting screws 10 and 11 while pedestal bottom walls 6B-7B support the holder when used in place on a horizontal surface such as a desk or counter top. Keyhole shaped openings at 12 and 13 in the pedestal rear walls are of inverted keyhole shape to removably mount the holder to the upright wall surface S.

Figure 5:
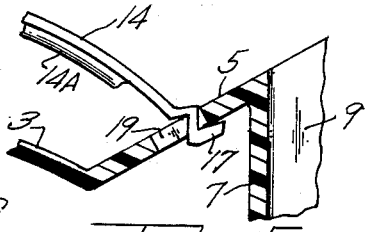
FIG. 5 is a vertical, sectional view taken along line 5—5 of FIG. 1.
Figure 6:
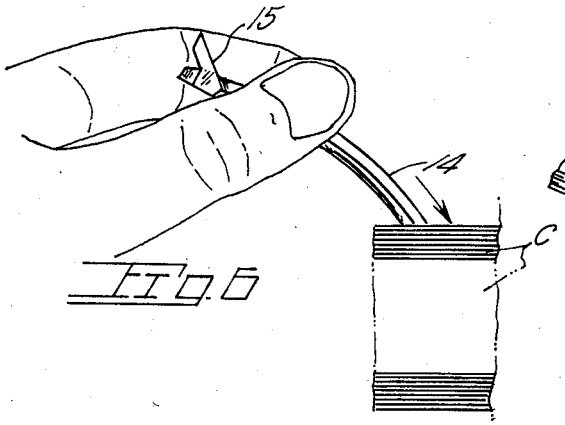
FIGS. 6 and 7 are elevational views of bridge assembly insertion and bridge assembly with card file installation on to the holder base.
Figure 7:
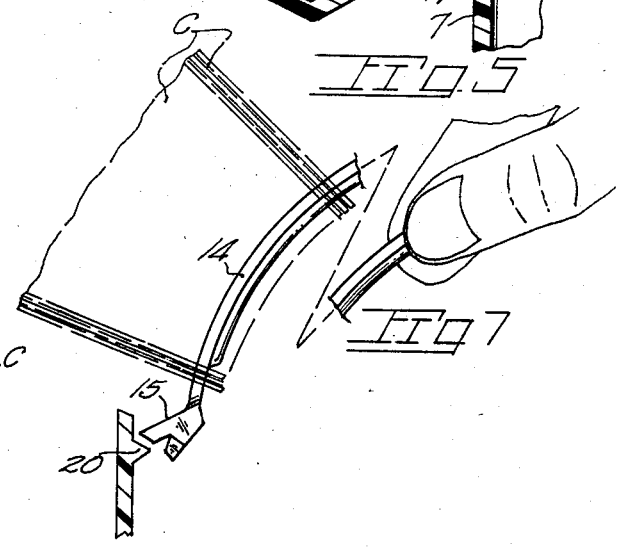

An arm assembly is supported in place by the extensions 4 and 5 as follows. The arm assembly includes arm members 13 and 14 which are of flexible construction and joined at their corresponding ends to a bridge member 15. Card supporting extension 4 defines an elongate opening 16 within which bridge 15 fits in a retained manner. The distal ends of arms 13 and 14, as best viewed in FIG. 5, terminate in hook segments as at 17 for inserted passage through openings 18 and 19 in card supporting extension 5. Accordingly, each arm end may be released by displacement toward the center of the holder followed by lifting of the arm end away from extension 5.

Figure 3:
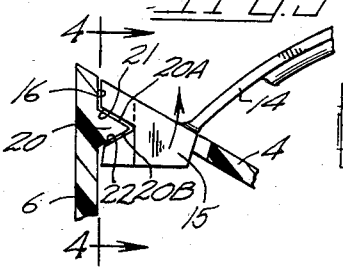
FIG. 3 is a vertical, sectional view taken along line 3—3 of FIG. 1.

With attention again to bridge 15 of the arm assembly, bridge retention means is embodied within a shoulder 20 having converging surfaces 20A-20B extending along opening 16 of the base. Engageable with said shoulder are inclined surfaces 21 and 22 longitudinally offset from one another along the bridge and which secure the bridge against upward vertical displacement, as viewed in FIG. 3. Detachment of the bridge from the holder may be accomplished only by upward rotational displacement of the bridge simultaneously with such movement of the distal arm ends in the general direction of the applied arrow of FIG. 3.

Figure 4:
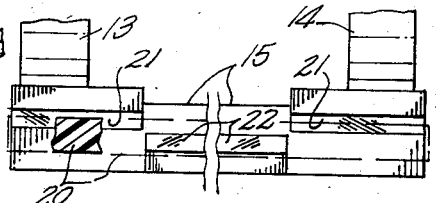
FIG. 4 is an elevational view of the arm assembly taken along line 4—4 of FIG. 3.

Additionally economical manufacture of the bridge by the injection molding process is facilitated by reason of the inclined surfaces 21 and 22 being longitudinally offset from one another with respect to the lengthwise axis of the bridge, as best viewed in FIG. 4.

The base 3 includes a frontal wall surface at 24 of an expanse rendering same useful for the display of advertising or company logo indicia. Permanent mounting of the arm assembly in achieved by the application of an adhesive agent such as a glue to the adjacent surfaces of the arm assembly and base. A suitable material for the holder is a high impact, synthetic resin.

While I have shown but one embodiment of the invention it will be apparent to those skilled in the art that the invention may be embodied still otherwise without departing from the spirit and scope of the invention.

Having thus described the invention, what is claimed and desired to be secured under Letters Patent is:

1. A card file holder comprising in combination, a base including a card suporting extension defining an elongate opening, an arm assembly including a pair of flexible parallel arms, a bridge integral with corresponding ends of the arms, said arms adapted at their corresponding distal ends for inserted engagement with said base, arm assembly mounting means including a shoulder on said base and disposed in the extension defined opening and having converging surfaces, and said arm assembly bridge having inclined surfaces spaced apart from one another along the bridge for surfacial engagement with the converging surfaces of the shoulder whereby the arm assembly bridge may be rotated out of engagement with the base by a lifting motion manually imparted to the distal ends of said arms.

2. The card file holder claimed in claim 1 wherein said base includes pedestal means having angularly orientated back and bottom surfaces permitting alternative surfacial engagement of the base with upright or horizontal surfaces.

3. The card file holder claimed in claim 2 wherein said back surfaces define openings for the passage of fasteners.

* * * * *